US009682818B1

(12) United States Patent
Turner

(10) Patent No.: US 9,682,818 B1
(45) Date of Patent: Jun. 20, 2017

(54) TRASH CONTAINER ANCHOR SYSTEM

(71) Applicant: Shawn Turner, Bernice, LA (US)

(72) Inventor: Shawn Turner, Bernice, LA (US)

( * ) Notice: Subject to any disclaimer, the term of this patent is extended or adjusted under 35 U.S.C. 154(b) by 0 days.

(21) Appl. No.: 14/995,807

(22) Filed: Jan. 14, 2016

Related U.S. Application Data

(60) Provisional application No. 62/104,728, filed on Jan. 17, 2015.

(51) Int. Cl.
*B65F 1/06* (2006.01)
*B65F 1/12* (2006.01)
*B65D 25/22* (2006.01)

(52) U.S. Cl.
CPC ..... *B65F 1/068* (2013.01); *B65D 25/22* (2013.01); *B65F 1/12* (2013.01); *B65F 2210/179* (2013.01)

(58) Field of Classification Search
CPC . B65F 1/068; B65F 1/12; B65D 25/20; B65D 25/22
USPC ..... 220/495.06, 636, 630, 629, 628, 483, 220/481, 480; 206/600, 386; 248/154, 248/146, 127
See application file for complete search history.

(56) References Cited

U.S. PATENT DOCUMENTS 4,760,987 A * 8/1988 Lan ..... A47K 1/09 248/346.11
4,955,493 A * 9/1990 Touzani ..... B65D 1/0292 215/372
5,474,206 A * 12/1995 Herring, Sr. ..... A47J 43/0727 220/630
5,875,912 A * 3/1999 Hobson ..... B43M 99/008 220/4.03
6,123,220 A * 9/2000 Williams ..... A47G 23/03 220/630
2008/0135693 A1* 6/2008 Naporano ..... A47D 13/02 248/121

* cited by examiner

*Primary Examiner* — Robert J Hicks
(74) *Attorney, Agent, or Firm* — Eldredge Law Firm; Richard G. Eldredge

(57) ABSTRACT

A combination of a trash container and an anchoring system. The trash container includes a body forming an inner cavity and a bottom surface and a ledge extending from the bottom surface. The anchoring system includes a platform having an upper surface and a lower surface; a plurality of suction cups secured to the lower surface of the platform, the plurality of suction cups being configured to secure the platform to a ground surface; and a channel member extending from upper surface of the platform, the channel member forming an elongated channel.

2 Claims, 5 Drawing Sheets

TRASH CONTAINER ANCHOR SYSTEM

BACKGROUND

1. Field of the Invention

The present invention is generally related to trash containers, and more particularly, to a trash container anchor system configured to secure the trash container to the ground during the bag unloading process.

2. Description of Related Art

Trash containers are well known in the art and are effective means to store and disposed of waste material. FIG. 1 depicts a simplified front view of a trash container 101 having a body 103 that forms a cavity configured to hold a trash bag 105 therein.

During use, removing the trash bag 105 from the trash container 101 can become a burdensome process due to a vacuum pressure formed in the cavity of the body 103. Thus, as depicted, a bottom surface 107 of body 103 has a tendency to pivot relative to the ground surface 109, which in turn could cause spilling of the trash waste material from bag 105. Difficulty is increased for the elderly and the physically impaired when trying to perform the bag lifting movement while conducting container lift at the same time. Additionally, even if vacuum is eliminated, friction between the bag and the container cavity prevents bag removal, as many containers are relatively light weight and simply lift off of the floor along with attempts to lift the bag from within. A lack of sturdiness of most containers container further inhibit the separation of bag and container, as the container is difficult to hold in a non-flexing posture.

Although great strides have been made in the area of trash container and methods to reduce the above-described problems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
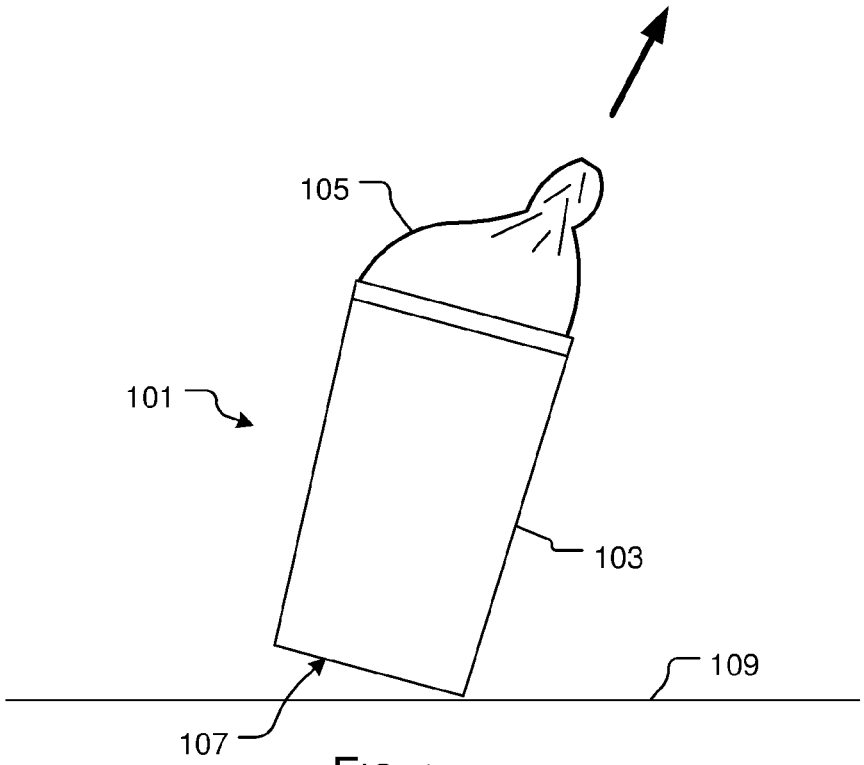
FIG. 1 (Prior Art)
FIG. 1 is a front view of a conventional trash container.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional trash containers. Specifically, the system of the present application includes an anchoring system that engages with a trash container and is configured to secure the trash container to a ground surface. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
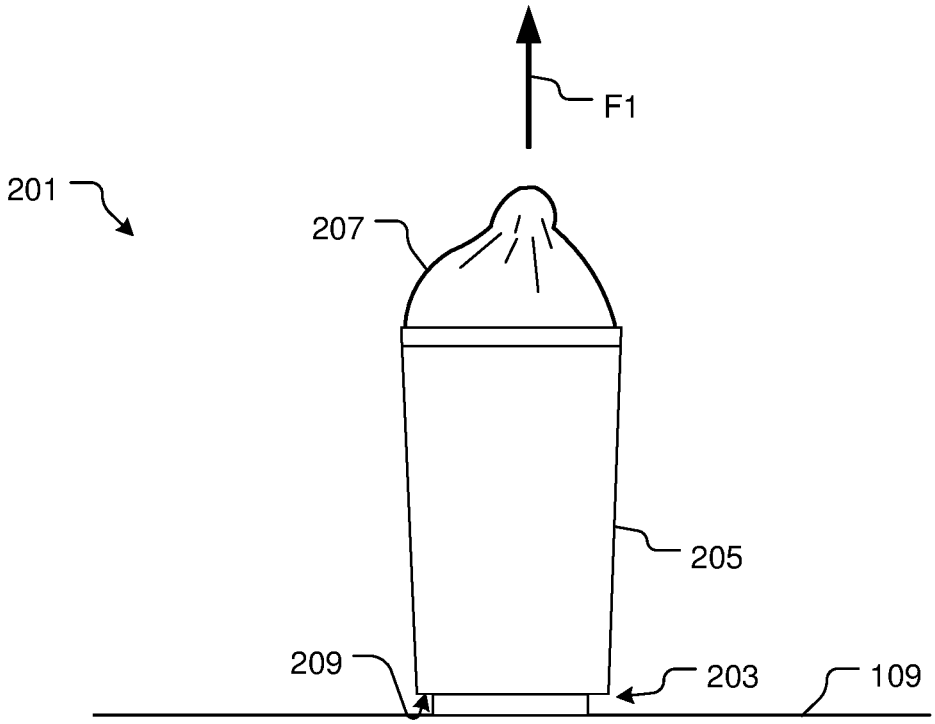
FIG. 2 is a front view of a trash container and anchoring system in accordance with a preferred embodiment of the present application.

Referring now to the drawings wherein like reference characters identify corresponding or similar elements throughout the several views, FIG. 2 depicts a front view of a trash container 201 with an anchoring system 203 in accordance with a preferred embodiment of the present application. It will be appreciated that the trash container 201 and operably associated anchoring system 203 overcomes one of more of the above-listed problems commonly associated with the conventional trash containers.

In the contemplated embodiment, trash container 201 includes a body 205 that forms a cavity (not shown) configured to receive a trash bag 207 therein. As a force F1 is applied to container 103, a vacuum pressure is formed within the cavity, which in turn restricts the deployment of the bag 207.

One of the unique features believed characteristic of the present application is the use of anchoring system 203 configured to removably secure the trash container body 205 to the ground surface 109. In the contemplated embodiment, the anchoring system 203 is secured to a bottom surface 209 of body 205. It will be appreciated that different types of anchoring systems are contemplated, as will be discussed more fully below.

Figure 3:
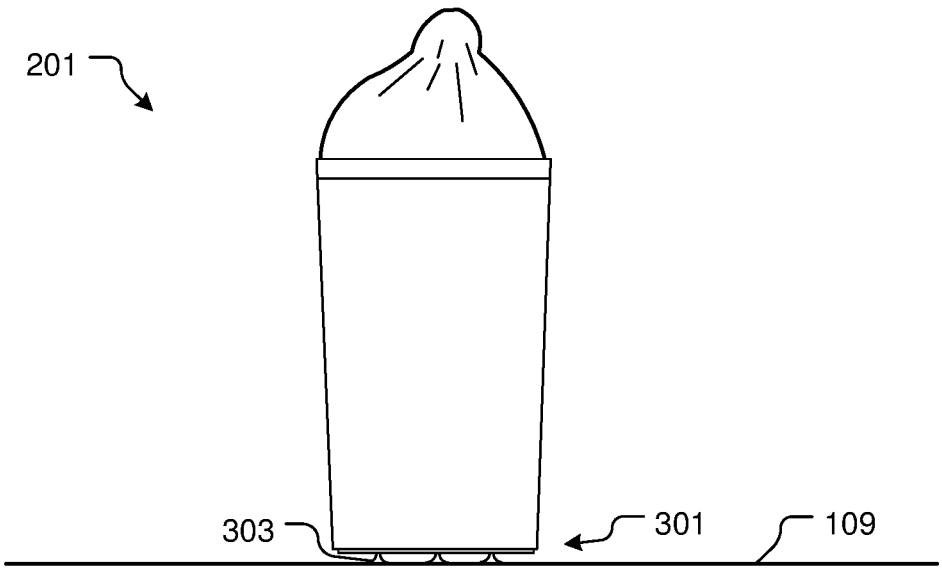
FIG. 3 is a front view of a trash container and anchoring system in accordance with an alternative embodiment of the present application.
Figure 4:
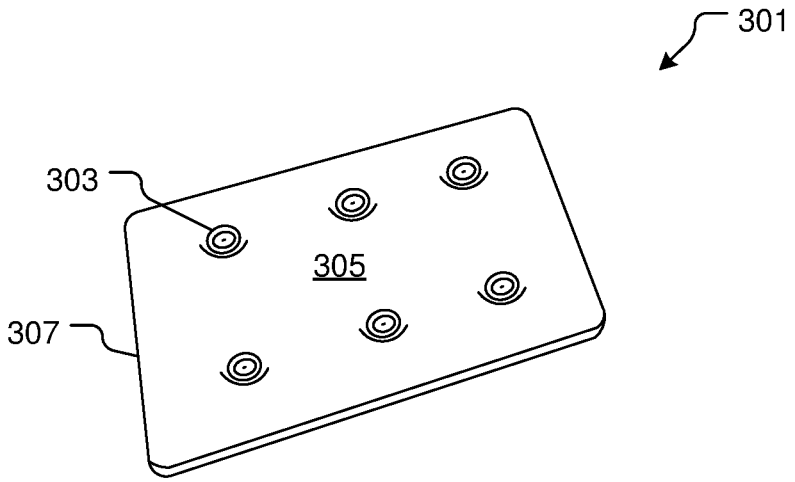
FIG. 4 is a bottom oblique view of a base of the anchoring system of FIG. 3.
Figure 5:
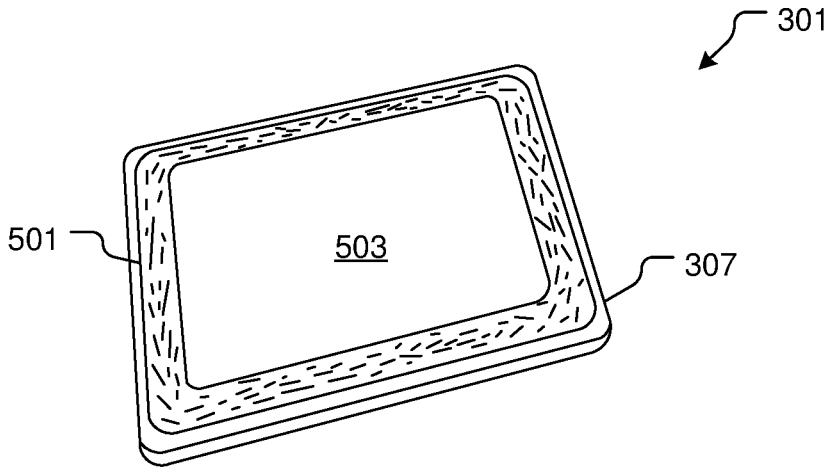
FIG. 5 is a top oblique view of the base of the anchoring system of FIG. 4.

As depicted in FIG. 3, one of the embodiments contemplated for an anchoring system is anchoring system 301, which utilizes a plurality of suction cups 303 configured to secure the trash container 203 to the ground surface 109. As shown in FIGS. 4 and 5, the plurality of suction cups 303 extend from a bottom surface 305 of platform 307, while an adhesive material 501 is adhered to a top surface 503 of platform 307. When assembled, the adhesive is applied to a bottom surface 209 of the body 205 of the trash container 203.

Figure 6:
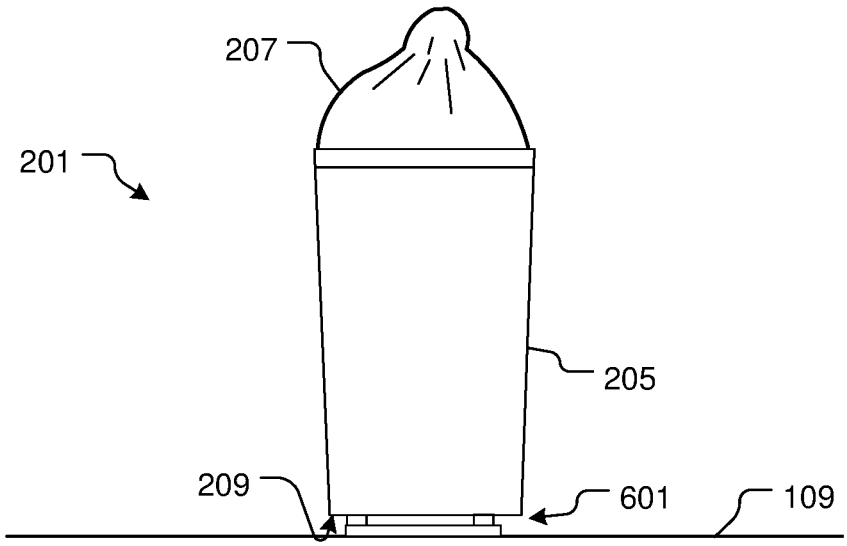
FIG. 6 is a front view of a trash container and anchoring system in accordance with an alternative embodiment of the present application.
Figure 7:
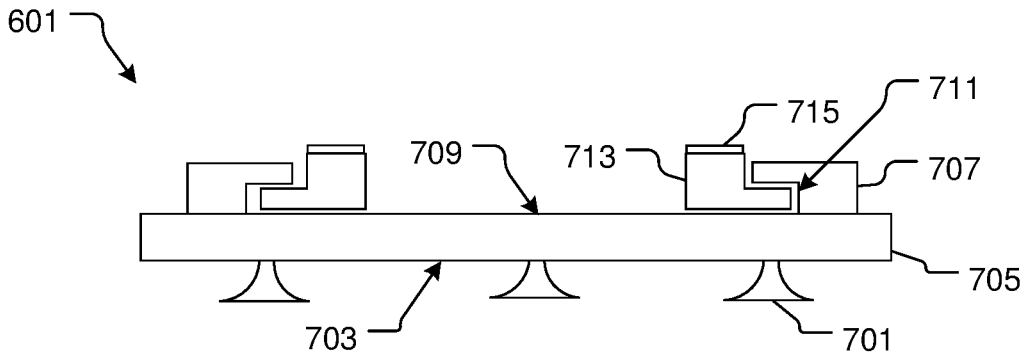
FIG. 7 is an enlarged front view of the anchoring system of FIG. 6.
Figure 8:
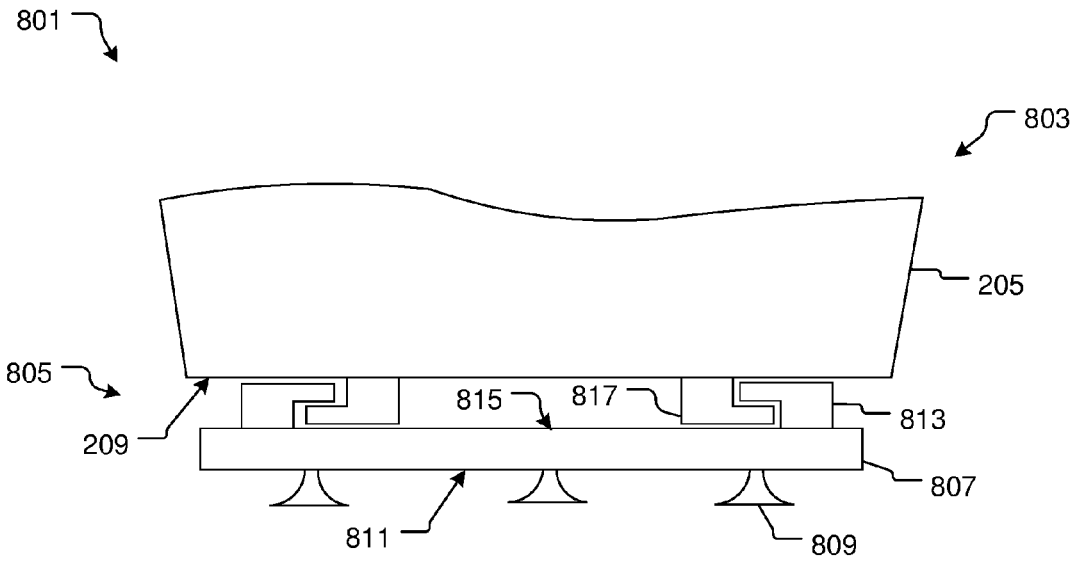
FIG. 8 is a front view of a trash container and anchoring system in accordance with an alternative embodiment of the present application.

Thus, in the preferred embodiment, suctions cups are utilized as an anchoring means to secure the trash container to the ground surface. However, it will be appreciated that alternative embodiments could utilize other types of fastening means such as hook-loop fasteners, clips, clamps, and the like in lieu of the preferred embodiment. Also, it should be appreciated that the anchoring system 201 could incorporate other means to secure the anchoring platform 307 to the trash container body 205. For example, FIGS. 6-8 illustrate alternative embodiments wherein the anchoring system is either rigidly or removably secured to the trash container. It will also be appreciated that it is also contemplated having a trash container that includes the suction cups and/or other anchoring means rigidly attached to the bottom surface 209.

Referring now to FIGS. 6 and 7 in the drawings, an alternative embodiment of anchoring system 201 is shown. In the contemplated embodiment, anchoring system 601 is configured allow removable engagement of the trash container 203 while the anchoring system 601 remains secured to the ground surface. To achieve this feature, anchoring system 601 includes a plurality of suction cups 701 extending from and secured to a bottom surface 703 of platform 705 and a plurality of channel members secured to and extending from a top surface 709 of platform 705.

In the contemplated embodiment, channel members 707 are configured to form elongated channels 711 configured to receive a ledge 713 configured to secure to the bottom surface 209 of the trash container 203 via an adhesive material 715. Thus, during use, the channel member and ledge slidingly engage with each other, which in turn allow removal of the trash container from the anchoring system while the anchoring system remains secured to the ground via suction cups 701.

Of course, it should be appreciate that alternative embodiments could utilize different types of fastening means in lieu of the channel and ledge configuration. For example, a clip, snap, hook-loop, and/or other quick release device could be used in lieu of the exemplary embodiment. The unique feature of anchoring system 601 allows removal of the trash container without the need to remove the anchoring system.

Referring now to FIG. 8 in the drawings, an alternative embodiment of anchoring system 201 is shown. In the contemplated embodiment, anchoring system 801 is configured to engage with a trash container 803 that includes pre-built devices configured to engage with the anchoring system and which allows the trash container to be removed from the anchoring system while the anchoring system remains attached to the ground surface. To achieve this feature, anchoring system 801 includes a plurality of suction cups 809 extending from and secured to a bottom surface 811 of a platform 807 and a plurality of channel members 813 secured to and extending from a top surface 815 of platform 807.

In the contemplated embodiment, channel members 813 are configured to form elongated channels to receive a ledge 817 fixedly attached to the bottom surface 209 of container body 205. During use, the channel member 813 and ledge 817 slidingly engage with each other, which in turn allow removal of the trash container from the anchoring system while the anchoring system is secured to the ground via suction cups 809.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A combination of a trash container and an anchoring system, comprising:

the trash container having:

a body forming an inner cavity and a bottom surface; and the anchoring system having:

a first ledge having a top surface with an adhesive layer;

a second ledge having a top surface with an adhesive layer;

a platform having an upper surface and a lower surface;

a plurality of suction cups secured to the lower surface of the platform, the plurality of suction cups being configured to secure the platform to a ground surface;

a first channel member extending from the upper surface of the platform, the first channel member forming a first elongated channel;

a second channel member extending from the upper surface of the platform, the second channel member forming a second elongated channel;

wherein the adhesive layers of the first ledge and the second ledge are configured to secure to the bottom surface of the trash container;

wherein the first ledge is configured to slidingly engage with the first channel member; and wherein the second ledge is configured to slidingly engage with the second channel member.

2. A method, comprising:

providing the combination trash container and the anchoring system of claim 1;

attaching the first ledge and the second ledge to the bottom surface of the trash container;

removably securing the anchoring system to the ground surface via the plurality of suction cups; and removably attaching the trash container to the anchoring system via the first ledge and the first channel member and the second ledge and the second channel member.

* * * * *